US007357568B2

(12) United States Patent
Gerber et al.

(10) Patent No.: US 7,357,568 B2
(45) Date of Patent: Apr. 15, 2008

(54) RUNNING RESERVE INDICATOR FOR A MECHANICAL CLOCKWORK

(75) Inventors: Paul Gerber, Zürich (CH); Willy Meier, Fontaines (CH)

(73) Assignee: Eterna SA (CH)

( * ) Notice: Subject to any disclaimer, the term of this patent is extended or adjusted under 35 U.S.C. 154(b) by 63 days.

(21) Appl. No.: 10/564,549

(22) PCT Filed: Jul. 8, 2004

(86) PCT No.: PCT/CH2004/000434

§ 371 (c)(1),
(2), (4) Date: Aug. 2, 2006

(87) PCT Pub. No.: WO2005/006088

PCT Pub. Date: Jan. 20, 2005

(65) Prior Publication Data

US 2007/0041277 A1 Feb. 22, 2007

(30) Foreign Application Priority Data

Jul. 14, 2003 (EP) ..... 03405533

(51) Int. Cl.
*G04B 9/00* (2006.01)

(52) U.S. Cl. ..... 368/212; 368/210; 368/140; 368/66

(58) Field of Classification Search ..... 368/140, 368/141–154, 210, 233, 235, 64, 66
See application file for complete search history.

(56) References Cited

U.S. PATENT DOCUMENTS

| | | | | |
|---|---|---|---|---|
| 1,039,165 | A * | 9/1912 | McGugan et al. | 368/210 |
| 6,340,241 | B2 * | 1/2002 | Jeanneret | 368/210 |
| 6,805,482 | B2 * | 10/2004 | Berard | 368/151 |
| 2001/0024405 | A1 * | 9/2001 | Jeanneret | 368/203 |
| 2004/0145974 | A1 | 7/2004 | Berard | |
| 2005/0007888 | A1 * | 1/2005 | Jolidon | 368/110 |

FOREIGN PATENT DOCUMENTS

| | | | |
|---|---|---|---|
| EP | 1024416 | A2 | 8/2000 |
| EP | 1260883 | A1 | 11/2002 |
| WO | WO 2005/006087 | | 1/2005 |

OTHER PUBLICATIONS

English translation of a PCT Written Opinion for PCT/CH2004/000434 (6 pages).

* cited by examiner

*Primary Examiner*—P. Austin Bradley
*Assistant Examiner*—Sean Kayes
(74) *Attorney, Agent, or Firm*—Finnegan, Henderson, Farabow, Garrett & Dunner, LLP

(57) ABSTRACT

A running reserve indicator is provided for a mechanical clockwork provided with a main barrel for driving a gear-train and at least a second barrel for driving a gear-train allocated to an auxiliary function which is performed during a determined period. With the indicator, the running reserve displayed with the aid of a hand and a dial is always equal to the running reserve of the barrel having the smallest reserve.

16 Claims, 3 Drawing Sheets

RUNNING RESERVE INDICATOR FOR A MECHANICAL CLOCKWORK

This application is a national stage filing under 35 U.S.C. § 371 of International Application No. PCT/CH2004/000434, filed on Jul. 8, 2004.

TECHNICAL FIELD

The present invention relates to the movements of mechanical watches whose energy is provided by a spring contained in a barrel. It relates more particularly to a running reserve indicator mechanism of a mechanical timepiece movement provided with a main barrel for driving the finishing gear-train and at least one second barrel for driving a gear-train assigned to an auxiliary function that must be performed during a minimum determined period.

BACKGROUND

Such a mechanism applies particularly well to a chronograph mechanical watch movement displaying the hour and the minute of the measured time with the aid of disks. In this case, the minimum determined period is equal to the maximum measurable time.

It is known that this type of display, better than a display by hands, makes it possible to provide indications of large dimensions, hence quicker and easier to read, as may be desired, for example, by aircraft pilots.

The problem that then arises is that of the mechanical energy necessary to drive the disks. Specifically, the single barrel risks being under stress, which disrupts the amplitude of the oscillations of the balance and, consequently, the correct operation of the chronograph gear-train.

EP application No 03 405532.7 provides a solution to this problem by proposing a movement in which the disks of the hours, the tens of minutes and the units of minutes of measured time are each driven by their own barrel.

In such a product, it is very useful, to perform the chronograph function over a minimum period, for the wearer to have an indication of the running reserve the movement has, both for the basic function and for the chronograph function.

The object of the present invention is to respond to this need.

SUMMARY OF THE INVENTION

To achieve this objective, the running reserve indicator mechanism according to the invention, of the aforementioned type, comprises:

- running reserve indicator means comprising a hand and a dial used for reading the position of the hand,
- first and second gear-trains connecting respectively the main barrel and the second barrel to said indicator means,
- these means and these gear-trains being arranged so that the indicated running reserve corresponds to the time remaining to perform the auxiliary function.

Advantageously, the indicated running reserve is that of the barrel having the shortest reserve.

According to a preferred embodiment, the indicator means and the gear-trains are such that:

- so long as the timepiece operates without the chronograph function, the hand starts moving only after a running time corresponding to the difference between the running time of the main barrel and that of the second barrel,
- as soon as the chronograph function is engaged, the hand starts moving and indicates the running reserve of the barrel having the shortest reserve.

Furthermore, the indicator means and the gear-trains are such that:

- so long as the rewinding of the timepiece has not reached a state corresponding to a running time equal to that of the second barrel, the dial rotates but the hand remains immobile,
- as soon as the rewinding has reached said state, the dial and the hand rotate at the same time.

BRIEF DESCRIPTION OF THE DRAWINGS

Other features of the invention will emerge from the following description given with reference to the appended drawing in which.

DETAILED DESCRIPTION

Figure 1:
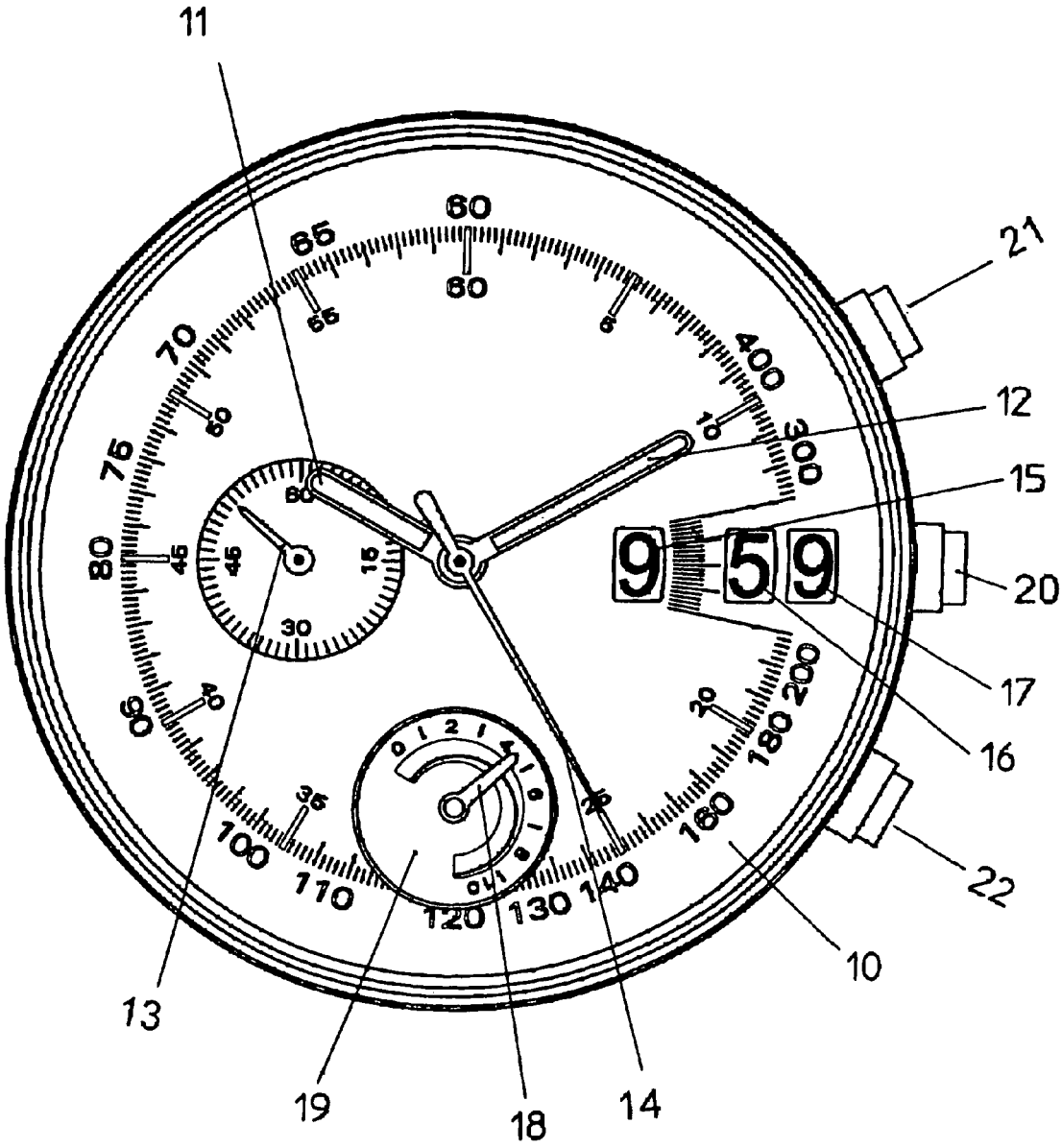
FIG. 1 represents a chronograph watch furnished with a movement displaying the measured time with the aid of disks.

The chronograph watch represented schematically in FIG. 1 is intended to display, on a dial 10, in conventional manner, the hour, the minute and the second of the current time with the aid of two central hands 11, 12 and a small hand 13 at 9 o'clock.

The watch also displays the seconds of measured time with the aid of a central hand 14, while the indications of the hours, tens of minutes and units of minutes of the measured time are provided respectively by three disks 15, 16 and 17 appearing behind windows made in the dial 10.

Finally, a small hand 18 and a small rotating dial 19 are placed at 6 o'clock to display the running reserve of the timepiece, as will be described with reference to FIG. 2.

The movement of this watch has, as a basis, a mechanical caliber of the chronograph type, such as that marketed by the company ETA SA (Switzerland) under the reference 7750. It is coupled to a complementary mechanism described in detail in the abovementioned EP document and driving the disks 15, 16 and 17.

In conventional manner, a crown 20 is used for rewinding and setting the time, while two pushbuttons 21 and 22 control respectively the starting and stopping and zeroing of the chronograph mechanism.

Reference will now be made to FIG. 2, split into two parts 2*a* and 2*b*, in which only the members participating in the function for displaying the running reserve are represented.

Figure 2A:
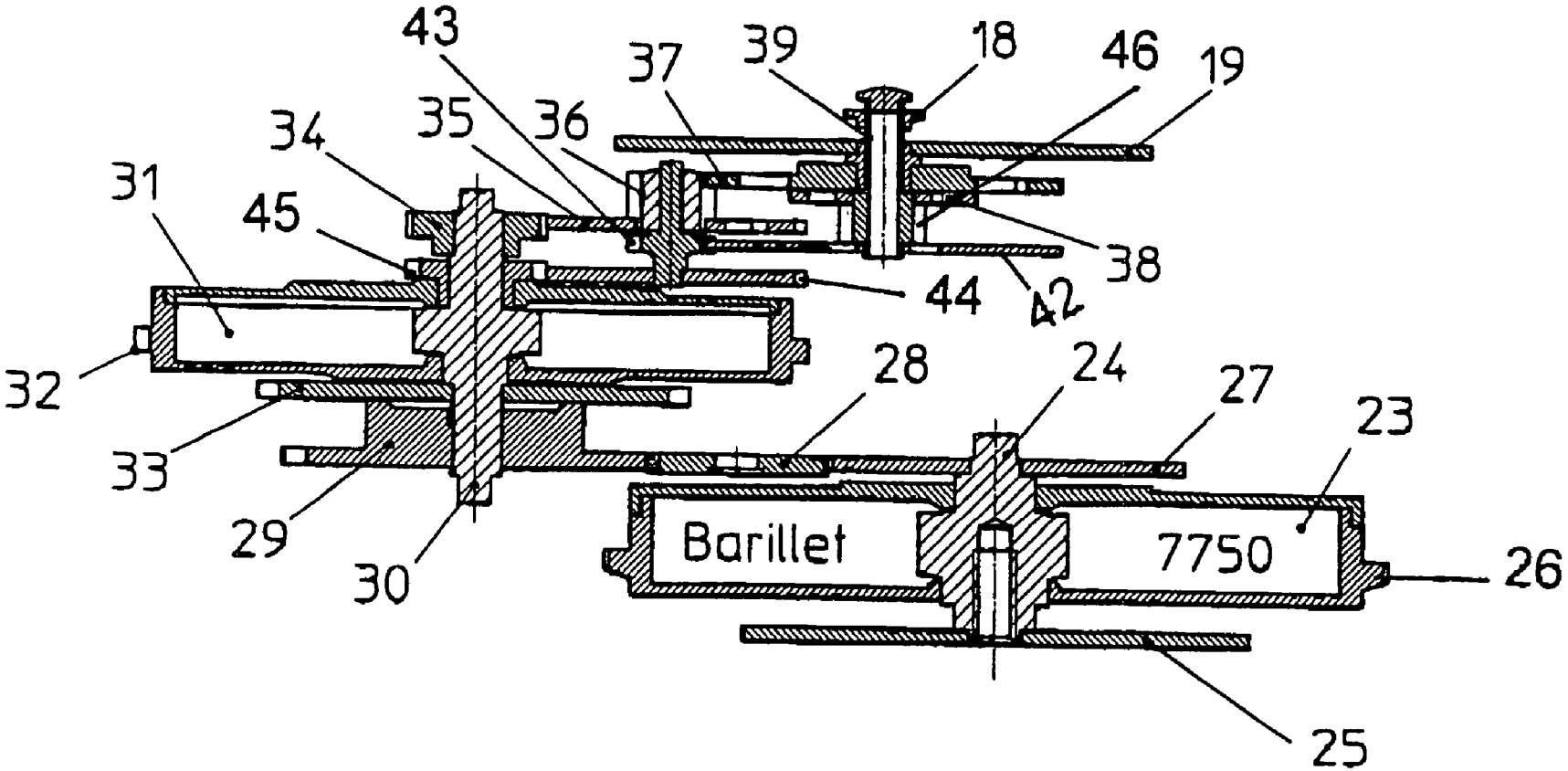
FIG. 2 is a view of the members of this movement which provide an indication of its running reserve.

FIG. 2*a* represents at reference number 23 the barrel of the basic movement which forms the main motive force of the watch. This barrel, which typically has a running time of approximately 40 hours, comprises, inside its drum, a spring (not shown) furnished with a sliding strap that is used, when it is fully primed, to limit its being overstressed. Its shaft 24 supports a ratchet 25 that may be driven, from the crown 20, by the rewind gearwheel and the crownwheel (not shown). The external tooth gear 26 of the drum engages with the finishing gear-train (not shown) which drives the hour hand 11, minute hand 12 and second hand 13.

Opposite the ratchet 25, the shaft 24 supports a wheel 27 engaging with an angle transmission 28 which itself engages with a wheel 29 attached to the shaft 30 of a second barrel 31 whose drum also contains a spring with sliding strap and whose running time is that during which the chronograph function must be performed. Typically, this running time is 10 hours. The external tooth gear 32 of the drum of this barrel engages with a gear-train (not shown) driving the disk 17 for displaying the units of minutes of the measured time. The shaft 30 also supports, on the same side, a ratchet 33 which engages with a gear-train terminating at the ratchet of a third barrel (not shown) used to drive the disk 16 for displaying the tens of minutes of the measured time.

As described in the EP document already cited, the third barrel actuates a fourth barrel used to drive the disk 15 for displaying the hours of the measured time.

Opposite the ratchet 33, the shaft 30 supports a gearwheel 34 which engages with a wheel 35 whose gearwheel 36 engages with a wheel 37 furnished with a lug 38 and supporting the running reserve indicator dial 19.

The wheel 37 is mounted pivotingly on a shaft 39 on which are mounted the hand 18 indicating the running reserve and, opposite, a wheel 40 (visible in FIG. 2*b*) furnished with a circular opening 41 whose length corresponds to the time during which the chronograph function must be performed, that is approximately 10 hours.

Opposite the hand 18, the shaft 39 supports, friction-mounted, a wheel 42 which engages with the gearwheel 43 of a wheel 44 whose shaft is used as a pivot to the wheel 35 and which engages with a second gearwheel 45 supported by the shaft 30 of the second barrel 31.

Figure 2B:
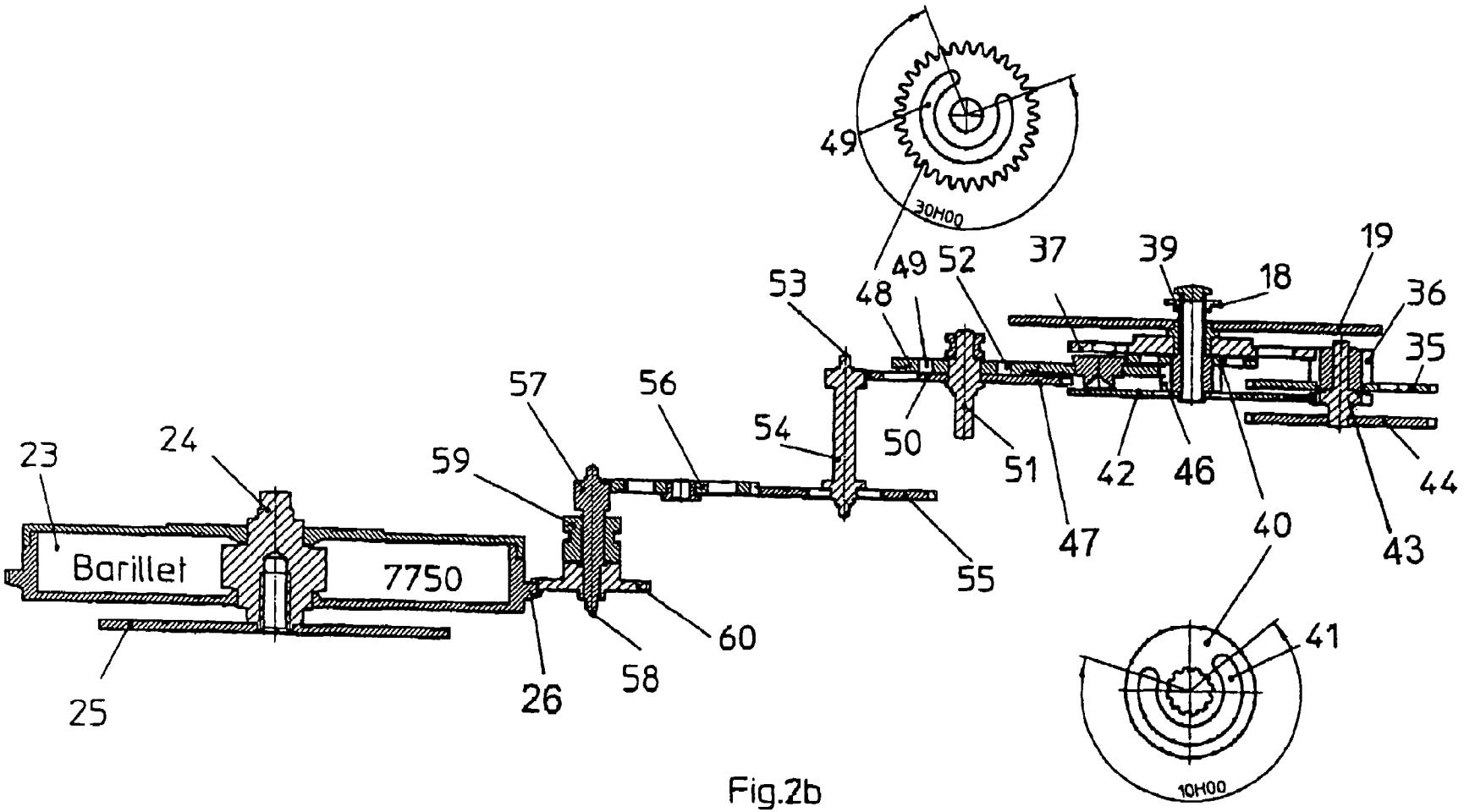

As shown in FIG. 2*b* in which the hand 18, the dial 19 and the associated members described with reference to FIG. 2*a* can be seen, the shaft 39 supports, between the open wheel 40 and the friction wheel 42, a gearwheel 46 which engages with an angle transmission 47 engaging with a wheel 48 furnished with a circular opening 49 whose length corresponds to a rotation period of approximately 30 hours. A wheel 50, mounted free in rotation on the shaft 51 of the wheel 48, is furnished with a lug 52 situated in the opening 49.

The wheel 50 engages with a gearwheel 53 whose shaft 54 supports, friction-mounted, a wheel 55 engaging, by means of an angle transmission 56, with a gearwheel 57 whose shaft 58 supports a gearwheel 59 engaging, by means of a wolf-tooth gear, with a mobile 60 which engages with the external tooth gear 26 of the drum of the main barrel 23.

The operation of the mechanism according to the invention will now be described in the following four situations:

rewinding the first 10 hours, rewinding beyond 10 hours, running without the chronograph function, running with the chronograph function.

1. Rewinding the First 10 Hours

When the ratchet 25 is driven, from the crown 20, by the rewind gearwheel and the crown wheel, the shaft 24 rewinds the spring of the main barrel 23 and, at the same time, the spring of the second barrel 31 by means of the mobiles 27, 28 and 29 and the shaft 30.

The gearwheel 34, also supported by the shaft 30, drives, by means of the wheel 35 and its gearwheel 36, the wheel 37 and the running reserve indicator dial 19 which, rotating in the anticlockwise direction, causes the hand 18, practically immobile, to indicate an increase in the running reserve. At the same time, the lug 38 of the wheel 37 moves freely in the opening 41 of the wheel 40 which, therefore, does not rotate.

When the rewinding reaches a state corresponding to a running time of at least 10 hours for the two barrels, the hand 18 indicates, on the dial 19, a running reserve of 10 hours. The lug 38 also reaches abutment against the end of the opening 41 of the wheel 40.

2. Rewinding Beyond 10 Hours

When the rewinding continues, the wheel 40 starts rotating under the action of the lug 38, thus driving the hand 18 at the same time as its dial 19, so that the running reserve display remains on 10 hours. Since the wheel 42 is friction-mounted on the gearwheel 46, it remains in a position corresponding to that of the barrel 31 with which it is connected via the gearwheel 43, the wheel 44 and the gearwheel 45.

The wheel 40 also drives, via the gearwheel 46 and the angle transmission 47, the wheel 48 whose opening 49 receives the lug 52 of the wheel 50. When the rewinding reaches a state corresponding to a running period of approximately 30 hours, this lug reaches abutment against the end of the opening 48. The wheel 50 therefore begins to rotate and, by means of the mobiles 53, 55, 56, 57 and 58, drives the gearwheel 59. The latter, however, due to the presence of the wolf-tooth gear mobile 60, has no effect on the main barrel 23.

It will be noted that, due to the use of springs with sliding strap, the rewinding by the actuation of the rewinding crown 20 may continue without damage.

3. Running without the Chronograph Function

In normal operation of the watch, the drum of the main barrel 23 is the only element in action and therefore drives the gear-train for displaying the current time via its outer tooth gear 26, which also drives the wolf-tooth gear mobile 60 which, in this direction of rotation, communicates its movement to the lugged wheel 50.

Accepting that the timepiece has been fully rewound, the wheel 50 will thus rotate for approximately 30 hours without influencing the display of the running reserve, still on 10 hours, because its lug 52 circulates freely in the opening 49 of the wheel 48. At the end of these 30 hours of running, the lug reaches abutment on the end of the opening 49 and the wheel 48 starts rotating. By means of the angle transmission 47, the gearwheel 46 and the shaft 39, it begins to cause the running reserve indicator hand 18 to rotate in the anticlockwise direction from the 10-hour position. Although the second barrel 31 is inactive and wheel 42 is therefore immobile, the movement of the hand 18 is allowed since this wheel is friction-mounted on the shaft 39.

When the hand 18 has thus traveled along a path corresponding to the movement of the lug 38 in the opening 41 of the wheel 40, that is 10 hours, it will indicate a 0 reserve on the dial 19 and the main barrel 23 will therefore be discharged by approximately 40 hours.

It will be noted that, thanks to the presence of the friction wheel 55 inserted in the gear-train linking the shaft 39 to the barrel 23, the latter is not prevented from discharging completely when the hand 18 reaches the 0 position.

4. Running with the Chronograph Function

As soon as the chronograph function is engaged, the second barrel 31 is put into action every minute and influences the indication of the running reserve. Its gearwheel 45 therefore begins to drive, by means of the wheel 44, the gearwheel 43, the wheel 42 and the shaft 39, the running reserve indicator hand 18 which begins to move in the anticlockwise direction. The shaft 39 drives the gearwheel 46 and the wheel 40. The latter engages via its gearwheel 46 with the angle transmission 47 which drives the open wheel 48.

Evidently, the main barrel is still in action and drives the wheel 50 whose lug 52 will reach abutment against the end of the opening 49 of the wheel 48 after 30 hours, to which is added the time during which the chronograph mechanism has operated, because of the synchronous movement of the wheels 50 and 48. In other words, if the chronograph mechanism has been engaged for 3 hours, the lug 52 will reach abutment only after 33 hours. As the hand 18 indicates a running reserve equal to 10 hours minus 3 hours, it will reach zero after 40 hours of operation of the main barrel.

If the measurement of a measured time begins while the running reserve of the main barrel is less than 10 hours, the lug 52 also causes the wheel 48 to rotate. It is then essential to prevent the two barrels adding their actions together on the control of the hand 18.

It will be noted that, for this purpose, the wheel 48 is also acted upon by the rotation of the wheel 42 driven by the second barrel 31. Thus, because the wheels 48 and 50 are driven at the same speed and, due to a gear shake equal to at least one minute (made necessary by the fact that the barrel 31 advances in steps of one minute), the lug 52 of the wheel will remain in the same position relative to the end of the opening 49 of the wheel 48. Thanks to these arrangements, the hand 18 is thus driven without conflict between the two barrels, the same displayed running reserve corresponding to that of the main barrel.

The mechanism described is incorporated into a watch furnished with a manual rewind of the barrel springs. It is evident that it may be directly applied to a watch with automatic rewind.

In this way, a mechanism for displaying the running reserve is proposed indicating only the running time necessary to perform the chronograph function, set at 10 hours, while the timepiece has, for the current time display function, a reserve of 40 hours.

In other words, the indicator hand 18 is driven degressively, from 10 hours to 0:

either after 30 hours of operation of the timepiece, so long as the chronograph is not engaged, or as soon as the chronograph is engaged, which requires a reserve of 10 hours.

The invention claimed is:

1. A running reserve indicator mechanism of a mechanical timepiece movement provided with a main barrel for driving a finishing gear-train and at least a second barrel for driving a gear-train assigned to an auxiliary function that must be performed during a determined period, the mechanism comprising:

a running reserve indicator comprising a hand and a dial used for reading the position of the hand, first and second gear-trains connecting, respectively, the main barrel and the second barrel to the running reserve indicator, the running reserve indicator and the first and second gear-trains being arranged so that the indicated running reserve corresponds to the time remaining to perform the auxiliary function.

2. The mechanism as claimed in claim 1, wherein the running reserve indicator and the first and second gear-trains are arranged so that the indicated running reserve is that of the barrel having the shortest reserve.

3. The mechanism as claimed in claim 2, wherein the auxiliary function is a chronograph function, and wherein the running reserve indicator and the first and second gear-trains are such that:

so long as the timepiece operates without the chronograph function, the hand starts moving only after a running time corresponding to the difference between the running time of the main barrel and that of the second barrel, and as soon as the chronograph function is engaged, the hand starts moving and indicates the running reserve of the barrel having the shortest reserve.

4. The mechanism as claimed in claim 3, wherein the running reserve indicator and first and second gear-trains are such that:

so long as the rewinding of the timepiece has not reached a state corresponding to a running time equal to that of the second barrel, the dial rotates but the hand remains immobile, and as soon as the rewinding has reached the state corresponding to a running time equal to that of the second barrel, the dial and the hand rotate at the same time.

5. The mechanism as claimed in claim 4, wherein the running reserve indicator also comprises:

a shaft to which the indicator hand is attached and the dial is mounted pivotingly, a first wheel also attached to the shaft and furnished with a circular opening whose length corresponds to a running time substantially equal to the running time of the second barrel, a second wheel mounted pivotingly on the shaft, fixedly attached to the dial and furnished with a lug situated in the circular opening, a fourth wheel friction-mounted on the shaft, and a first gearwheel attached to the shaft.

6. The mechanism as claimed in claim 3, wherein the running reserve indicator also comprises:

a shaft to which the indicator hand is attached and the dial is mounted pivotingly, a first wheel also attached to the shaft and furnished with a circular opening whose length corresponds to a running time substantially equal to the running time of the second barrel, a second wheel mounted pivotingly on the shaft, fixedly attached to the dial and furnished with a lug situated in the circular opening, a fourth wheel friction-mounted on the shaft, and a first gearwheel attached to the shaft.

7. The mechanism as claimed in claim 6, wherein the first gear-train connects a tooth gear of the main barrel to the first gearwheel and comprises:

a fifth wheel fixedly attached in rotation to the first gearwheel and provided with a circular opening whose length corresponds to the difference between the running time of the main barrel and that of the second barrel, and a sixth wheel fixedly attached in rotation to the tooth gear mounted free in rotation on the shaft of the fifth wheel and furnished with a lug situated in its opening.

8. The mechanism as claimed in claim 7, wherein the first gear-train also comprises, inserted between the sixth wheel and the tooth gear of the main barrel, a seventh wheel friction-mounted and a wolf-tooth gear mobile.

9. The mechanism as claimed in claim 2, wherein the running reserve indicator and the first and second gear-trains are such that:

so long as the rewinding of the timepiece has not reached a state corresponding to a running time equal to that of the second barrel, the dial rotates but the hand remains immobile, and as soon as the rewinding has reached the state corresponding to a running time equal to that of the second barrel, the dial and the hand rotate at the same time.

10. The mechanism as claimed in claim 9, wherein the running reserve indicator also comprises:

a shaft to which the indicator hand is attached and the dial is mounted pivotingly, a first wheel also attached to the shaft and furnished with a circular opening whose length corresponds to a running time substantially equal to the running time of the second barrel, a second wheel mounted pivotingly on the shaft, fixedly attached to the dial and furnished with a lug situated in the circular opening, a fourth wheel friction-mounted on the shaft, and a first gearwheel attached to the shaft.

11. The mechanism as claimed in claim 2, wherein the running reserve indicator also comprises:

a shaft to which the indicator hand is attached and the dial is mounted pivotingly, a first wheel also attached to the shaft and furnished with a circular opening whose length corresponds to a running time substantially equal to the running time of the second barrel, a second wheel mounted pivotingly on the shaft, fixedly attached to the dial and furnished with a lug situated in the circular opening, a fourth wheel friction-mounted on the shaft, and a first gearwheel attached to the shaft.

12. The mechanism as claimed in claim 11, wherein the first gear-train connects the tooth gear of the main barrel to the first gearwheel and comprises:

a fifth wheel fixedly attached in rotation to the first gearwheel and provided with a circular opening whose length corresponds to the difference between the running time of the main barrel and that of the second barrel, and a sixth wheel fixedly attached in rotation to the tooth gear mounted free in rotation on the shaft of the fifth wheel and furnished with a lug situated in its opening.

13. The mechanism as claimed in claim 12, wherein the first gear-train also comprises, inserted between the sixth wheel and the tooth gear of the main barrel, a seventh wheel friction-mounted and a wolf-tooth gear mobile.

14. The mechanism as claimed in claim 1, wherein the running reserve indicator also comprises:

a shaft to which the indicator hand is attached and the dial is mounted pivotingly, a first wheel also attached to the shaft and furnished with a circular opening whose length corresponds to a running time substantially equal to the running time of the second barrel, a second wheel mounted pivotingly on the shaft, fixedly attached to the dial and furnished with a lug situated in the circular opening, a fourth wheel friction-mounted on the shaft, and a first gearwhell attached to the shaft.

15. The mechanism as claimed in claim 14, wherein the first gear-train connects a tooth gear of the main barrel to the first gearwheel and comprises:

a fifth wheel fixedly attached in rotation to the first gearwheel and provided with a circular opening whose length corresponds to the difference between the running time of the main barrel and that of the second barrel, and a sixth wheel fixedly attached in rotation to the tooth gear mounted free in rotation on the shaft of the fifth wheel and furnished with a lug situated in its opening.

16. The mechanism as claimed in claim 15, wherein the first gear-train also comprises, inserted between the sixth wheel and the tooth gear of the main barrel, a seventh wheel friction-mounted and a wolf-tooth gear mobile.

* * * * *